United States Patent [19]

Rajani et al.

[11] Patent Number: 4,581,119

[45] Date of Patent: Apr. 8, 1986

[54] APPARATUS FOR SEPARATING A DISPERSED LIQUID PHASE FROM A CONTINUOUS LIQUID PHASE BY ELECTROSTATIC COALESCENCE

[75] Inventors: Jayantilal B. Rajani; Stephanus Paardekooper, both of Amsterdam, Netherlands

[73] Assignee: Shell Oil Company, Houston, Tex.

[21] Appl. No.: 736,007

[22] Filed: May 20, 1985

[30] Foreign Application Priority Data

May 30, 1984 [GB] United Kingdom ..... 8413734

[51] Int. Cl.[4] ..... B01D 13/02

[52] U.S. Cl. ..... 204/302; 204/260; 204/272

[58] Field of Search ..... 204/302, 260, 272

[56] References Cited

U.S. PATENT DOCUMENTS 3,577,336 5/1971 Shirley ..... 204/32

3,582,527 6/1971 Lucas ..... 204/302

3,801,492 4/1974 King ..... 204/302

4,469,582 9/1984 Sublette et al. ..... 204/302

*Primary Examiner*—R. L. Andrews

[57] ABSTRACT

Apparatus for separating a dispersed liquid phase from a continuous liquid phase by electrostatic coalescence comprising an elongated vessel having an inlet and outlet. The vessel is divided into a first compartment and a second compartment with the compartments being in fluid communication with one another. Each compartment is provided with a plurality of substantially parallel cylindrical cathodic elements arranged in the main flow direction, and a plurality of rod-like anodic elements, each element being substantially concentrically arranged inside a cathodic element. The cathodic elements of the first compartment have cross-sectional areas substantially larger than the cross-sectional areas of the cathodic elements of each consecutive compartment.

6 Claims, 4 Drawing Figures

FIG. 3
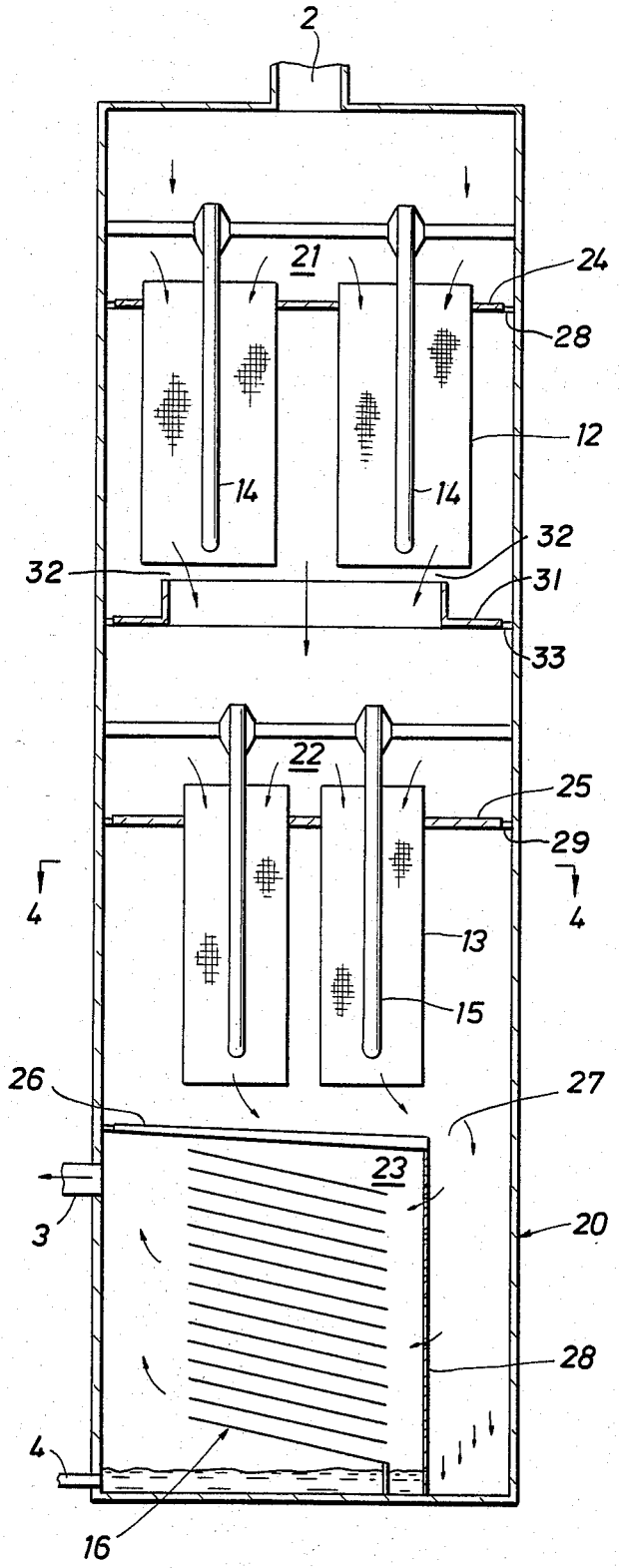
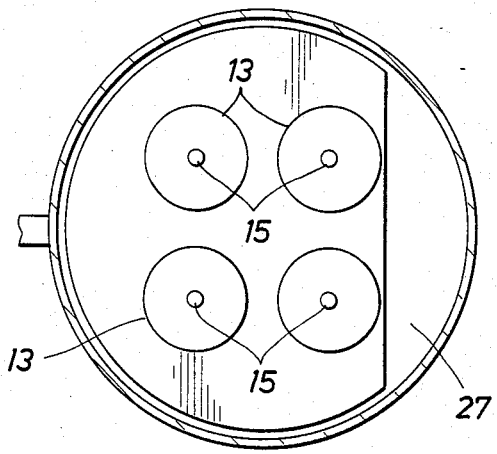
FIG. 4

APPARATUS FOR SEPARATING A DISPERSED LIQUID PHASE FROM A CONTINUOUS LIQUID PHASE BY ELECTROSTATIC COALESCENCE

BACKGROUND OF THE INVENTION

The present invention relates to an apparatus for separating a dispersed liquid phase from a continuous liquid phase by electrostatic coalescence and to a process in which use is made of such an apparatus, in particular a process for dehydrating hydrocarbon liquid emulsions in which such an apparatus is employed.

The term "coalescence" may be defined as the coming together of small droplets of liquid to form larger droplets permitting easier and more rapid phase separation. One of the methods for achieving coalescence of liquid droplets comprises subjecting a liquid emulsion to a suitable electric field of sufficient intensity to cause the dispersed liquid phase to coalesce. It will be understood that such an electrical treatment is only suitable if the dispersed liquid phase is relatively conductive and the continuous liquid phase is relatively non-conductive. The technique of electrostatic coalescence is well known and is widely applied, in particular in processes for dehydrating hydrocarbon liquid emulsions, such as crude oil desalted by washing with fresh water.

A large variety of different types of electrostatic separators have been proposed in the past and are commercially applied. Some of these separators are designed to produce uniform electric fields for effecting droplet-coalescence, whereas other separators are provided with internals to produce a non-uniform electric field for generating droplet-coalescence. In a uniform electric field the lines of forces are parallel to one another and the field strength is constant throughout the space between the electrodes. In a non-uniform electric field, however, the lines of forces are not parallel to one another and the field strength will therefore be a function of the location in the field.

The known electrostatic separators for liquid/liquid separation are normally equipped with electrodes having such a configuration that during operation uniform electric fields are generated. U.S. Pat. No. 3,582,527, for example, describes a system for resolving an emulsion by electrostatic coalescence, in which a vessel is provided with electrode means extending over the entire cross-section of the vessel to guarantee that the emulsion is completely subjected to a uniform electric field. Most electrostatic separators used for treating liquid emulsions is of the so-called uniform electric field type.

The electrostatic separators for separating solids from a continuous liquid phase or a gas phase, on the contrary, are normally provided with electrode means enabling the generation of non-uniform electric fields. Although the latter type of electric fields are less prone to maloperation due to short-circuiting, a problem occurs when separators of the non-uniform field type are used for separating liquid emulsions.

U. S. Pat. No. 3,577,336 is one of the relatively few publications describing an electric treater for liquid emulsions provided with rod-like electrodes in combination with electrodes surfaces that are substantially planar to generate non-uniform electric fields.

SUMMARY OF THE INVENTION

An object of the present invention is to further improve the known type of electrostatic separators to increase the separation efficiency, while simultaneously reducing the risk of short-circuiting or at least substantially minimizing it.

The apparatus for separating a dispersed liquid phase from a continuous liquid phase by electrostatic coalescence according to the invention comprises an elongated vessel with an inlet conduit at one end of the vessel and an outlet at the opposite end. The vessel is divided into at least first and second compartments with the compartments being in fluid communication with one another. Each compartment is provided with a plurality of substantially parallel, substantially cylindrical and open ended cathodic elements arranged in the main flow direction. A plurality of rod-like anodic elements are disposed substantially concentrically inside the cathodic elements. The cathodic elements of one compartment have cross-sectional areas substantially larger than the cross-sectional areas of the cathodic elements of each consecutive compartment.

During operation of the apparatus, a liquid mixture of a continuous liquid phase with droplets of a second liquid dispersed therein is caused to flow via the inlet conduit of the vessel in longitudinal direction through the cylindrical cathodic elements of the first compartments. Subsequently the mixture flows through the narrower cylindrical cathodic elements of the second compartment and through the cathodic elements of additional compartments, if any are present. In the first compartment the large droplets in the continuous phase will first tend to coalesce under the influence of the electrical forces generated. The large droplets, especially if they coalesce with one another, might form a risk for short-circuiting between the cathodic and the anodic elements. The distance between the cathodic elements and the accompanying anodic elements in the first compartment should therefore be chosen relatively large. If the coalesced droplets are large enough, they will begin to separate from the continuous liquid phase by gravitation. The continuous liquid phase leaving the first compartment will contain only a minor amount of dispersed liquid phase in the form of only small droplets. In the second compartment, the liquid is again subjected to electrical forces, promoting a further separation of the dispersed liquid phase by coalescence and subsequently gravitation. Since the risk of short-circuiting in the second compartment is less pronounced due to the reduced number of oversized liquid droplets, the distance between the cathodic elements and accompanying anodic elements in this second compartment may be substantially smaller than the corresponding distance in the first compartment. Smaller distances between the cathodic and the anodic elements allows the further compartments to be more effectively filled with such elements, which in its turn means that higher separation efficiencies are obtainable.

The cathodic elements are preferably grounded via the body of the vessel. Said elements are suitably formed by substantially cylindrical perforated cages to enable an easy removal of coalesced liquid droplets from the continuous liquid phase. It should be noted that adherence of liquid droplets to the cathodic elements might adversely affect the electrical forces generated between the cathodic elements and the anodic elements. By perforating the cathodic elements such adherence of liquid can be largely eliminated.

The rod-like anodic elements are preferably coated with a thin layer of insulating material, for example methyl methacrylate or polytetrafluoroethylene, to prevent direct contact of the anodic elements with the liquid mixture. The use of an electrically insulating material on the anodic elements reduces the loss of charge which can occur by short-circuiting through the liquid dispersion. It should be noted that for the same reason the cathodic elements might also be coated with a thin layer of insulating material. As already mentioned hereinbefore it is, however, preferred to use perforated cathodic elements so that not only is the loss of charge prevented but also an escape for dispersed liquid from the cathodic enclosures is created. In addition to the perforations of the cathodic elements, these elements may be further provided with a thin layer of insulating material for further reducing the risk of short-circuiting.

In the proposed apparatus, both continuous AC and pulsed DC power can be used. It has been found that a pulsed DC field is superior to a continuous AC field, in particular at low applied voltages. For both the continuous AC and the pulsed DC apparatus the field strengths are of the order of several kilovolts.

It has further been found that the separation efficiency is dependent on the concentration of dispersed phase, in that fluids with a relatively low concentration of dispersed phase should be subjected to electric fields of relatively high voltage.

The apparatus according to the invention is further provided with an exit compartment having a mechanical separator device formed by a plurality of parallel, flat or corrugated, surfaces arranged at an inclination with respect to the flow of liquid from the previous compartment. The advantage of having a mechanical separator device in addition to the electrostatic separator elements may be explained as follows. While electrical forces are advantageous for promoting the formation of enlarged droplets, they are particularly detrimental in the exit region of an electric field. Under the influence of electrical forces the droplet dispersal mechanism is such that the droplets produced are much smaller than the original droplet. When produced in the exit region of an electric field these droplets do not recoalesce and are generally of such a small size that quite long retention times are required for their gravitation if settling distances are appreciable. By providing a further mechanical separator unit the retention times can be significantly reduced.

BRIEF DESCRIPTION OF THE DRAWINGS

The invention will now be described by way of example only with reference to the accompanying drawings, in which:

FIG. 3 shows a schematic view of a vertical section of a second apparatus according to the invention.

FIG. 4 shows a cross-section of FIG. 3 taken along the lines IV—IV.

DESCRIPTION OF PREFERRED EMBODIMENTS

Figure 1:
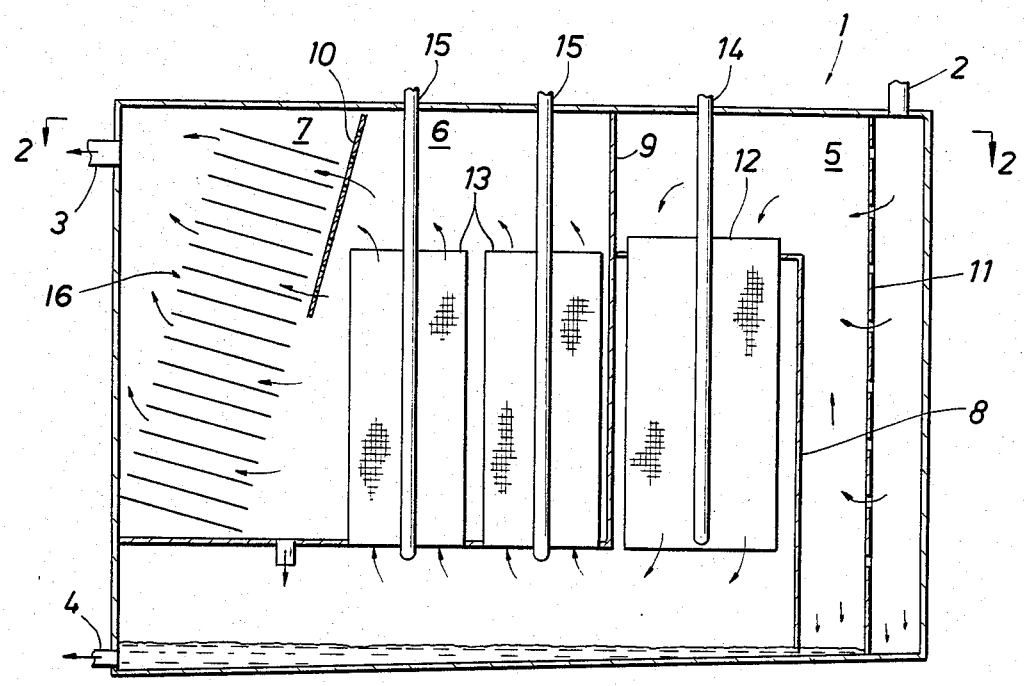
FIG. 1 shows a schematic view of a vertical section of a first apparatus according to the invention.
Figure 2:
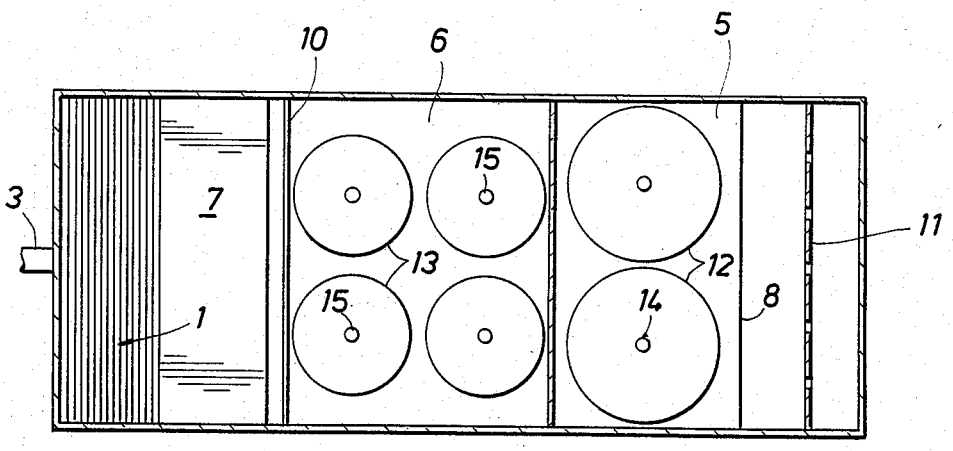
FIG. 2 shows a cross-section of FIG. 1 taken along the lines II—II.

Referring to FIGS. 1 and 2, a horizontally extending version of an apparatus according to the invention is shown. The shown apparatus comprises a horizontally extending elongated vessel 1 having an inlet conduit 2 at one end thereof for a liquid dispersion and two outlet conduits 3 and 4 at its opposite end for separate withdrawal of liquid forming the continuous phase of the introduced liquid dispersion and of the liquid forming the dispersed phase of the introduced liquid dispersion, respectively. The interior of the vessel 1 is divided into three compartments, indicated with reference numerals 5, 6 and 7, the compartments being bounded by substantially vertically extending baffles 8, 9 and a perforated baffle 10. Near the inlet conduit 2, the vessel is provided with a liquid distributor formed by a substantially vertically extending perforated baffle 11. The compartments 5 and 6 are each provided with a plurality of vertically extending cylindrical open ended elements 12 and 13. The elements 12 and 13 have perforated walls and are grounded to the body of the vessel 1 to create the cathodes. The elements may for example, be formed of expanded metal or heavy screen. The elements 12 of the first compartment 5 have a larger diameter than the elements 13 in further compartment 6, in view of the higher risk of short-circuiting occurring during operation in the first compartment. The shown apparatus further comprises a plurality of anodic elements 14 and 15 in the form of elongated rods extending substantially concentrically with the cathodic elements 12 and 13 respectively. The anodic elements 14 and 15 are connected to a high voltage source (not shown). The cathodic elements 12 and 13 and anodic elements 14 and 15 are provided with a thin layer of insulating material, such as polytetrafluoroethylene, not shown in the Figures.

Exit compartment 7 of the apparatus is provided with a mechanical separator unit 16 consisting of a plurality of parallel plates arranged at angle with respect to the horizontal. A suitable parallel plate interceptor is described in U.S. Pat. No. 3,346,122. The main flow direction of liquid through the apparatus has been indicated in the FIGS. 1 and 3 with arrows.

The separation of a dispersed liquid phase from a continuous liquid phase using the above apparatus will be described for a water-in-hydrocarbon emulsion. The water-in-hydrocarbon emulsion is introduced into vessel 1 via inlet conduit 2, and distributed over substantially the full height of the vessel via the perforated baffle 11. The emulsion then flows in a downward direction through the spaces enclosed by the cathodic elements 12 of the first compartment 5. In this compartment the water-in-oil emulsion is subjected to pulsed DC fields generated via the anodic elements 14. The electrical fields cause coalescence of the water into drops of increased size and some are large enough to initiate their gravitation into a body of water in the lower part of vessel 1. After having passed through compartment 5, the hydrocarbon liquid, already dehydrated to a considerable extent, will flow in upward direction through the interiors of the cathodic elements 13 of the second compartment 6. In this second compartment the hydrocarbon liquid is subjected to a further electrostatic treatment. Since the cathodic elements in compartment 6 are substantially smaller in diameter than those in compartment 5, the electric fields generated via the anodic elements in this further compartment are substantially more concentrated enabling a further coalescence of dispersed liquid droplets. The liquid is subsequently caused to flow along the parallel plates of the mechanical separator unit 16. Small water droplets, still present in the continuous hydrocarbon phase, contact the surface of the plates and travel along said surfaces while additional coalescence takes place. The water leaves the surfaces of the plates with sizes large enough to gravitate downward towards the bottom part of the vessel 1. The hydrocarbon liquid ascends to join the collected liquid in the upper part of exit compartment 7. The separated hydrocarbon liquid and the separated water are subsequently recovered via outlet conduit 3 and outlet conduit 4, respectively.

Reference is now made to FIGS. 3 and 4 showing an alternative of the apparatus shown in FIGS. 1 and 2. Identical elements shown in both sets of Figures have been indicated with the same reference numerals. The further shown apparatus, being of the so-called vertical type, comprises a substantially cylindrical, vertically extending vessel 20. The vessel is subdivided into a plurality of compartments 21, 22 and 23 arranged above one another and formed by substantially horizontal partition walls 24, 25 and 26. The horizontal partition walls 24 and 25 are provided with passages 28 and 29 at their edges that allow the downward flow of separated water. The water-in-hydrocarbon emulsion flows from the top compartment 21 to the middle compartment 22 by means of an opening 30 in a partition wall 31 as shown by the arrows 32. The partition wall 26 is of such a shape that passage 27 is left between the edge of said wall and the inner surface of vessel 20, allowing the downward flow of liquid during operation of the vessel. The lower compartment 23, in which the mechanical separator device 16 is arranged, is further provided with a substantially vertically extending baffle 28 provided with perforations for the distribution of liquid over the full height of separator device 14.

For the operation of the apparatus shown in FIGS. 3 and 4, reference is made to the description of the first shown apparatus.

It should be noted that although the Figures show only two electrostatic separator compartments an apparatus according to the invention may be provided with more than two compartments provided with electrostatic separator means.

What is claimed is:

1. Apparatus for separating a dispersed liquid phase from a continuous liquid phase by electrostatic coalescence comprising:

a vessel having an inlet and separate outlets for said liquid phase and said dispersed liquid phase;

a plurality of baffles, said baffles being mounted in said vessel to divide said vessel into a series of compartments, said compartments being disposed in a serial sequence and having fluid communication with each other,;

a plurality of cylindrical open-ended cathodic elements mounted in said compartments, said cathodic elements being disposed parallel to the main flow direction, the cathodic elements in each succeeding compartment having smaller diameters than those of the preceding compartment; and a plurality of rod shaped anodic elements, one of said anodic elements being disposed substantially concentrically in each of said cathodic elements.

2. Apparatus as claimed in claim 1, wherein the cathodic elements are grounded to the body of the vessel.

3. Apparatus as claimed in claim 1, wherein the cathodic elements are formed by substantially cylindrical perforated cages.

4. Apparatus as claimed in any one of claims 1–3, wherein the anodic elements are provided with a thin layer of insulating material.

5. Apparatus as claimed in any one of claims 1–3, wherein the cathodic elements are provided with a thin layer of insulating material.

6. Apparatus as claimed in claim 1, wherein the vessel further includes an exit compartment provided with a mechanical separating device comprising a plurality of substantially parallel surfaces arranged at an inclination with respect to the main flow direction.

* * * * *